US006205939B1

(12) United States Patent
Janocha et al.

(10) Patent No.: US 6,205,939 B1
(45) Date of Patent: Mar. 27, 2001

(54) BUTTONHOLE SEWING MACHINE

(75) Inventors: Theodor Janocha; Wolfgang Buchta; Jörg Bunte; Karsten Filges; Klaus Meyer, all of Bielefeld (DE)

(73) Assignee: Durkopp Adler Aktiengesellschaft (DE)

( * ) Notice: Subject to any disclaimer, the term of this patent is extended or adjusted under 35 U.S.C. 154(b) by 0 days.

(21) Appl. No.: 09/521,300

(22) Filed: Mar. 9, 2000

(30) Foreign Application Priority Data

Mar. 19, 1999 (DE) ..... 199 12 291

(51) Int. Cl.[7] ..... D05B 3/06; D05B 47/04
(52) U.S. Cl. ..... 112/73; 112/248; 112/302
(58) Field of Search ..... 112/73, 65, 66, 112/68, 447, 302, 254, 255, 241, 242, 243, 248

(56) References Cited

U.S. PATENT DOCUMENTS 1,372,473 3/1921 Allen .
1,408,185 * 2/1922 Gatchell ..... 112/248
4,590,879 5/1986 Matsubara et al. .
6,044,780 * 4/2000 Kastrup et al. ..... 112/73 X
6,095,066 * 8/2000 Noltge et al. ..... 112/73 X

OTHER PUBLICATIONS

U.S. application No. 09/256,853, Eyelet–Buttonhole Sewing machine Cross–Reference to Related Application.

* cited by examiner

*Primary Examiner*—Peter Nerbun
(74) *Attorney, Agent, or Firm*—Robert F. I. Conte; Lee, Mann, Smith, McWilliams, Sweeney & Ohlson

(57) ABSTRACT

A buttonhole sewing machine comprises a needle thread feeding mechanism, in which the needle thread is guided over a cam disk, which performs a rotation during two stitches of the needle. Along its periphery, the cam disk has such a curvature that tensioning and releasing the needle thread complies with the requirements of alternately sewing a single thread chain stitch and a double thread chain stitch during the sewing of a zigzag buttonhole seam.

7 Claims, 2 Drawing Sheets

FIG.1
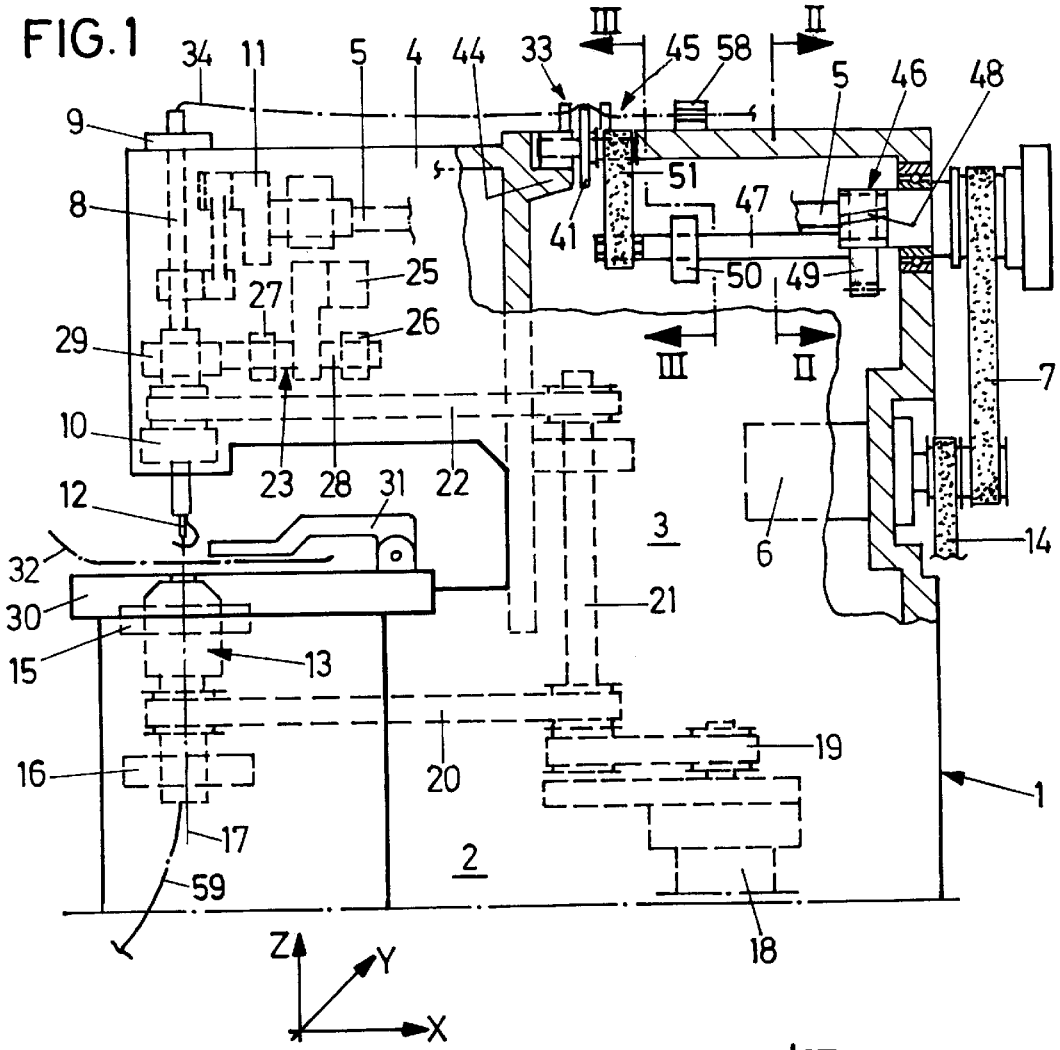
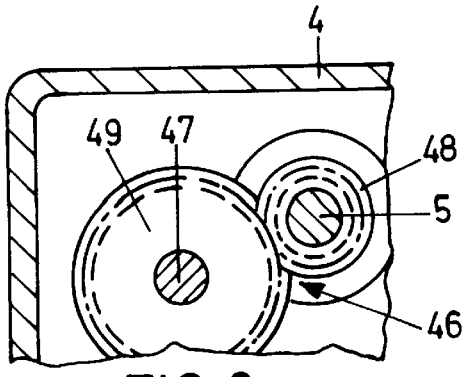
FIG.2
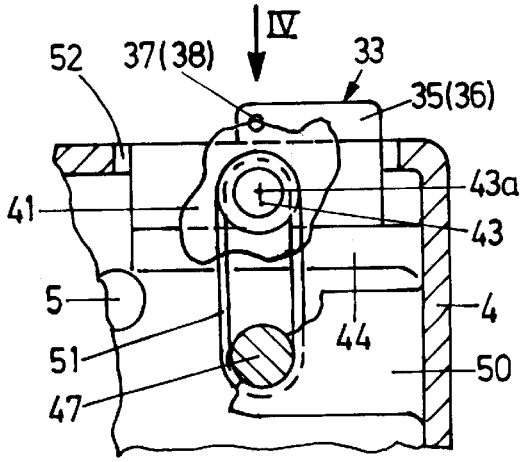
FIG.3

BUTTONHOLE SEWING MACHINE

BACKGROUND OF THE INVENTION

1. Field of the Invention

The invention relates to a buttonhole sewing machine for the production of buttonholes on a workpiece, comprising a needle mounted in an arm, which is reciprocatingly drivable in a Z direction for the production of stitches by means of a driving motor, and which is drivable by a jogging drive for the production of a zigzag seam by a motion of the needle relative to the workpiece, and which is drivable to pivot about an axis by means of a pivot drive; a hook bearing, which is disposed in a base plate, and which is drivable by a pivot drive to pivot synchronously and equiangularly relative to the needle about a pivot axis which extends in the Z direction; and a thread feeding mechanism in the path of a needle thread.

2. Background Art

In a buttonhole sewing machine of the generic type known from U.S. Pat. No. 1,372,473, which is designed for the production of eye type buttonholes, stitch forming takes place in a zigzagging sequence of stitches in a conventional and known manner by alternating single thread chain stitches and double thread chain stitches. In the case of a single thread chain stitch, no under-thread or hook thread is fed, whereas an under-thread or hook thread is fed in the case of a double thread chain stitch. This known buttonhole sewing machine is provided with a device for the control of the needle thread, in which, on a shaft that rotates at half the speed of the arm shaft a pair of disks, which co-rotate therewith, and a cam are disposed for the control of a thread clamp.

U.S. Pat. No. 4,590,879 teaches a thread feeding mechanism of a sewing machine, in which a cam disk is provided, which rotates at half the speed of the arm shaft and which, by two portions on its periphery that are remote from the axis of rotation and by two portions that are close to the axis of rotation, acts on the thread supplied to the needle in such a way that the thread is tensioned, i.e. it is pulled, or loosened, i.e. released.

SUMMARY OF THE INVENTION

It is an object of the invention to embody an buttonhole sewing machine of the generic type such that by simple means varying thread feedings are attained for the alternating production of a single thread chain stitch and a double thread chain stitch.

According to the invention, this object is attained by the features which consist in that the thread feeding mechanism comprises a closed cam for guidance of the needle thread, which is drivable by a thread feeding drive to rotate about an axis of rotation, the cam comprising two different cam sections for tensioning and releasing the needle thread, which extend over angles at circumference a, b of 180°, and the cam performing a rotation during two stitches of the needle. The measures according to the invention ensure that a single rotating and closed cam enables the varying thread feedings to be possible which are needed for the alternating production of a single thread chain stitch and a double thread chain stitch. Fundamentally, the cam can be formed as cam sections which, over the circumference of the cam, are radially equidistant from the axis of rotation and parallel thereto; however, the design according to which the cam has a radially varying distance from the axis of rotation along its circumference is particularly simple, since in this case the cam is formed on a plane that is perpendicular to the axis of rotation, in particular on a comparatively flat cam disk when the cam is formed on the periphery of a cam disk. In this case, needle thread guidance takes place preferably approximately parallel to the axis of rotation of the cam and in needle thread guides on two sides of the cam.

Actuation of the cam may take place by way of its proper independent drive, which is for instance electrically coupled with the needle drive; however, the embodiment according to which the thread feeding drive is branched from an arm shaft by a reducing gear is especially simple and safe.

The thread tension device provided by the advantageous development, according to which a thread tension device is disposed upstream of the thread feeding mechanism, is usually triggered such that the needle thread, which is fed from a thread supply to the thread feeding mechanism, is clamped or braked, respectively, when it is pulled from the thread feeding mechanism, i.e. when it is tensioned. The thread tension device again releases the needle thread when it is loosened, i.e. released on the cam.

Details of the invention will become apparent from the description of the ensuing exemplary embodiment, taken in conjunction with the drawing.

BRIEF DESCRIPTION OF THE DRAWING

FIG. 1 is an elevation, partially broken away, of a buttonhole sewing machine;

FIG. 2 is a section, on the line II—II of FIG. 1, through a thread feeder drive disposed in the arm of the sewing machine;

FIG. 3 is a cross-sectional view, on the line III—III of FIG. 1, of a thread feeder disposed in the arm of the sewing machine;

DESCRIPTION OF THE PREFERRED EMBODIMENT

Figure 4:
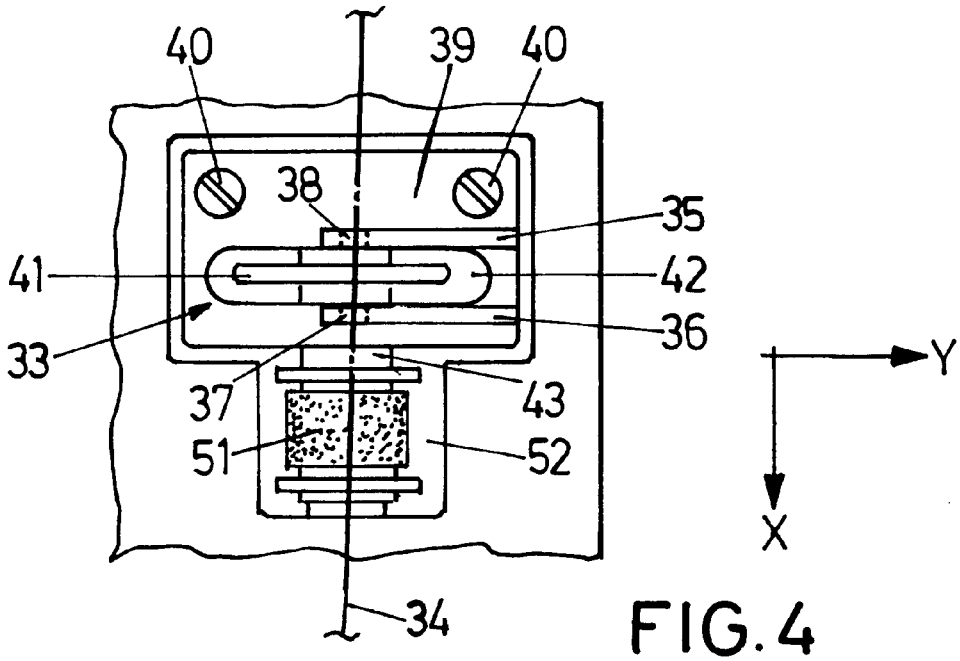
FIG. 4 is a plan view of the thread feeder corresponding to the arrow IV of FIG. 3.
Figure 5:
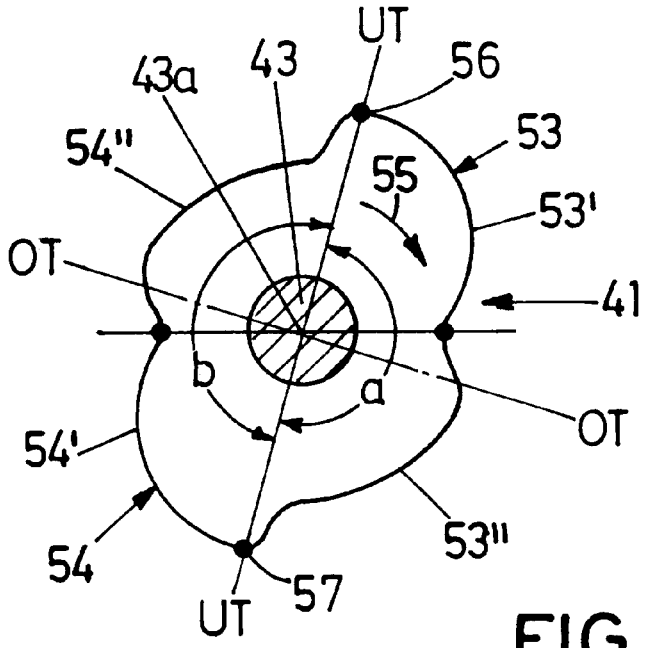
FIG. 5 is a plan view of a cam disk, seen in FIG. 3, of the thread feeder on an enlarged scale.

The single/double thread chain stitch sewing machine seen in FIG. 1 comprises a housing 1, which substantially consists of a so-called base plate 2, a standard 3 and an upper arm 4. An arm shaft 5 (discontinuous in the drawing) is rotatably run in the aim 4 and can be driven in rotation by means of a driving motor 6 via a belt drive 7.

Mounted in the arm 4 in bearings 9, 10 is a substantially vertical and hollow needle bar 8, which can be driven to reciprocate by the aim shaft 5 via a crank drive 11. At its lower end, the needle bar 8 is provided with a needle 12.

Underneath the needle bar 8, a hook bearing 13, which comprises two commercial chain stitch hooks (not seen in the drawing) known for example from U.S. Pat. No. 1,372,473, is mounted in bearings 15, 16 for rotation by approximately 400° about a vertical pivot axis 17 which extends in the Z direction. Actuation of the hooks takes place via a driving connection 14 derived from the driving motor 6. Rotary actuation of the hook bearing 13 takes place via two belt drives 19, 20 by means of a stepper motor which serves as a pivot drive 18. The needle bar 8 is mounted in the bearings 9, 10 not only for displacement in the longitudinal direction, but also for rotation about the pivot axis 17. It is driven synchronously and equiangularly relative to the hook bearing 13 by the pivot drive 18 via a setting shaft 21, which is drivable by the belt drive 19 and extends in the Z direction, and by a further belt drive 22, so that the needle 12 and the hook bearing 13 are synchronously and equiangularly pivoted about the pivot axis 17.

The needle bar 8 and the needle 12 are drivable to jog laterally, i.e. to swing, by means of a needle jogging drive 23. The lateral jogging motion is accompanied with a deflection of the needle bar 8 relative to the pivot axis 17. Due to the rotatability of the needle bar 8, the jogging plane of the needle bar 8 with the needle 12 is displaceable synchronously and equiangularly relative to the position of rotation of the hook bearing 13. A stepper motor 25 is provided for the lateral jogging of the needle bar 8, this stepper motor 25 acting on the needle bar 8 by way of a jogging shaft 28. To this end, provision is made for a transmission 29 (not shown in detail), which is known from U.S. Pat. No. 1,991,627 and U.S. patent application Ser. No. 09/256 853.

An X-Y table 30 (only roughly outlined) is disposed on the base plate 2. Design and actuation of the table 30 are also known from U.S. patent application Ser. No. 09/256 853. A clamp 31 is mounted on the table 30 for fixing a workpiece 32.

On the upper side of the arm 4, provision is made for a needle thread feeding mechanism denoted as a thread feeder 33 for a needle thread 34, which is fed to the needle 12 through the hollow needle bar 8 from the upper end thereof. The thread feeder 33 comprises two thread guide webs 35, 36, which are disposed at a distance from each other in the X direction and each of which has a hole 37, 38 in the vicinity of its upper side for the thread 34 to be threaded through. The holes 37, 38 are in alignment in the X direction. The two thread guide webs 35, 36 are mounted on a common base plate 39, which is fastened by screws 40 on the upper side of the arm 4. A cam disk 41 is disposed between the two thread guide webs 35, 36. This cam disk 41 passes through an opening 42 in the base plate 39 of the thread feeder 33. The cam disk 41 is provided with a driving shaft 43, which is run for rotation about its axis of rotation 43*a* in a bearing 44 in the arm 4.

Actuation of the plane and flat cam disk 41, which is radial to the axis of rotation 43*a,* takes place by means of a thread feeding drive 45 branched from the arm shaft 5. To this end, a branch shaft 47 is driven by the arm shaft 5 via a reducing gear 46. This reducing gear 46 comprises a pinion 48, which is non-rotatably mounted on the arm shaft 5, and a gearwheel 49, which is mounted on the branch shaft 47, the gearwheel 49 having precisely twice the number of teeth of the pinion 48 so that the reducing gear 46 has a reducing ratio of 1:2; in other words, the branch shaft 47 is driven at precisely half the speed of the arm shaft 5. The branch shaft 47 is run in bearings which are disposed in the arm 4 and of which only a bearing 50 is illustrated.

Transmitting the rotary actuation from the branch shaft 47 to the driving shaft 43 of the cam disk 41 takes place by means of a synchronous belt drive 51 of a transmission ratio of 1:1, i.e. the cam disk 41 is driven at precisely the same speed as the branch shaft 47, i.e. at precisely half the speed of the arm shaft 5. The thread feeding mechanism 33 passes through a recess 52 in the upper side of the arm 4.

Along its full circumference, the cam disk 41 has two cam sections 53, 54, each of which extending over angles at circumference a and b of 180°. The cam section 53 extends over the angle at circumference a—referred to the direction of rotation 55—of the cam disk 41 from the point 56 to the point 57. As compared to this, the cam section 54 extends over the angle at circumference b—likewise referred to the direction of rotation 55—from the point 57 to the point 56. The points 56 and 57 are allocated to the bottom dead center of the needle 12. Each cam section 53 and 54 has two partial cam sections 53' and 53', and 54' and 54". The partial cam sections 53', 53" and 54', 54" are embodied in the way of wave crests, i.e. when the needle thread 12 is guided along these partial cam sections, it is moved out of the alignment of the holes 37, 38. Simultaneously, it is clamped and braked by a needle thread tension device 58, which is located upstream of the thread feeder 33 in the path of the needle thread 34, so that it is pulled out over the partial cam section 53' upon upward motion of the needle 12 from its bottom dead center UT to its upper dead center OT, this pulling motion ending shortly before the upper dead center OT is reached. The partial cam section 53" has a similar curvature upon downward motion from the upper dead center OT to the bottom dead center UT. The same applies to the pulling and releasing of the needle thread 34 during its way over the cam section 54. The cam section 53 is provided for example for the production of a double thread chain stitch, whereas the cam section 54 is correspondingly formed for the production of a single thread chain stitch. In this case, the partial cam sections 53' and 53" have a greater radial convexity than the partial cam sections 54', 54". As also seen in the drawing, complete alleviation and release of the needle thread 34 takes place—referred to the direction of rotation 55—in each case shortly before the bottom dead center UT and the upper dead center OT of the needle 12 are reached.

The described sewing machine serves to sew buttonholes in the workpiece 32, for which two stitches are made at a distance from each other crosswise to the longitudinal direction of the buttonhole seam, i.e. in a zigzag pattern, one stitch of which is a single thread chain stitch, whereas the other stitch is a double thread chain stitch. The first stitch is produced without an under-thread, whereas the second stitch is made with a hook thread 59 being fed. This is general and familiar practice. Since two different chain stitches alternate, also the needle thread 34 must be fed to the needle 12 and retracted alternately in a varying manner. This takes place by way of the correspondingly adapted and varying design described of the cam sections 53, 54 of the cam disk 41 of the thread feeder 33.

What is claimed is:

1. A buttonhole sewing machine for the production of buttonholes on a workpiece (32), comprising a needle (12) mounted in an arm (4), which is reciprocatingly drivable in a Z direction for the production of stitches by means of a driving motor (6), which is drivable by a jogging drive (23) for the production of a zigzag seam by a motion of the needle (12) relative to the workpiece (32), and which is drivable to pivot about an axis by means of a pivot drive (18);

a hook bearing (13), which is disposed in a base plate (2), and which is drivable by a pivot drive (18) to pivot synchronously and equiangularly relative to the needle (12) about a pivot axis (17) which extends in the Z direction; and a thread feeding mechanism (33) in the path of a needle thread (34);

wherein the thread feeding mechanism (33) comprises a closed cam (53, 54) for guidance of the needle thread (34), which is drivable by a thread feeding drive (45) to rotate about an axis of rotation (43*a*), the cam (53, 54) comprising two different cam sections (53, 54) for tensioning and releasing the needle thread (34), which extend over angles at circumference a, b of 180°, and the cam (53, 54) performing a rotation during two stitches of the needle (12).

2. A buttonhole sewing machine according to claim 1, wherein the cam (53, 54) has a circumference and has a radially varying distance from the axis of rotation (43*a*) along that circumference.

3. A buttonhole sewing machine according to claim 2, wherein the cam (53, 54) is formed on a periphery of a cam disk (41).

4. A buttonhole sewing machine according to claim 2, wherein the needle thread (34) is guided approximately parallel to the axis of rotation (43*a*) of the cam (53, 54).

5. A buttonhole sewing machine according to claim 1, wherein the needle thread (34) is guided in needle thread guides (37, 38) on both sides of the cam (53, 54).

6. A buttonhole sewing machine according to claim 1, wherein the thread feeding drive (45) is branched from an arm shaft (5) by a reducing gear (46).

7. A buttonhole sewing machine according to claim 1, wherein a thread tension device (58) is disposed upstream of the thread feeding mechanism (33).

* * * * *